US010910753B2

(12) United States Patent
Miyamura et al.

(10) Patent No.: US 10,910,753 B2
(45) Date of Patent: Feb. 2, 2021

(54) CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 189 days.

(21) Appl. No.: 16/308,888

(22) PCT Filed: May 25, 2017

(86) PCT No.: PCT/JP2017/019513
§ 371 (c)(1),
(2) Date: Dec. 11, 2018

(87) PCT Pub. No.: WO2017/217208
PCT Pub. Date: Dec. 21, 2017

(65) Prior Publication Data

US 2020/0313334 A1 Oct. 1, 2020

(30) Foreign Application Priority Data

Jun. 15, 2016 (JP) ..... 2016-118636

(51) Int. Cl.
*H01R 13/42* (2006.01)
*H01R 13/20* (2006.01)
(Continued)

(52) U.S. Cl.
CPC ..... *H01R 13/42* (2013.01); *H01R 13/20* (2013.01); *H01R 13/502* (2013.01); *H01R 13/518* (2013.01); *H01R 13/639* (2013.01)

(58) Field of Classification Search
CPC ..... H01R 13/42; H01R 13/20; H01R 13/502; H01R 13/518; H01R 13/639
(Continued)

(56) References Cited

U.S. PATENT DOCUMENTS 6,702,614 B2 * 3/2004 Nakamura ..... H01R 13/4223 439/595
6,702,626 B2 * 3/2004 Ichio ..... H01R 13/4362 439/752
(Continued)

FOREIGN PATENT DOCUMENTS

JP 4-129483 11/1992
JP 10-64613 3/1998
(Continued)

OTHER PUBLICATIONS

International Search Report dated Aug. 8, 2017.

*Primary Examiner* — Peter G Leigh
(74) *Attorney, Agent, or Firm* — Gerald E. Hespos; Michael J. Porco; Matthew T. Hespos

(57) ABSTRACT

It is aimed to realize miniaturization. A connector includes a terminal unit (50) having a terminal holding member (51) and configured to be displaced between a partial locking position and a full locking position integrally with a retainer (30), a terminal fitting (58) mounted in the terminal holding member (51) such that a draw-out direction of a wire (61) is a direction intersecting a displacing direction of the retainer (30), a stopper (25) formed in the housing (10) and facing in a direction opposite to the draw-out direction of the wire (61), and a butting portion (54) formed on the terminal holding member (51), the butting portion being not locked
(Continued)

to the stopper (25) with the retainer (30) held at the partial locking position and being lockable to the stopper (25) by a displacement of the retainer (30) to the full locking position.

7 Claims, 13 Drawing Sheets

(51) Int. Cl.
*H01R 13/502* (2006.01)
*H01R 13/518* (2006.01)
*H01R 13/639* (2006.01)

(58) Field of Classification Search
USPC ..... 439/660
See application file for complete search history.

(56) References Cited

U.S. PATENT DOCUMENTS 7,488,211 B2 * 2/2009 Yamaoka ..... H01R 13/4364 439/595
8,052,489 B2 * 11/2011 Mase ..... H01R 13/6272 439/752
8,602,819 B2 * 12/2013 Uchida ..... H01R 13/502 439/596
8,678,865 B2 * 3/2014 Hiraishi ..... H01R 13/4365 439/752
9,017,111 B2 * 4/2015 Zheng ..... H01R 13/4223 439/744
9,099,804 B2 * 8/2015 Suzuki ..... H01R 13/4361
9,106,000 B2 * 8/2015 Mizutani ..... H01R 13/5219
9,257,773 B2 * 2/2016 Kitajima ..... H01R 13/4362
9,257,774 B2 * 2/2016 Hirano ..... H01R 13/4365
9,281,600 B2 * 3/2016 Hirano ..... H01R 13/4362
9,300,072 B2 * 3/2016 Horiuchi ..... H01R 13/506
9,306,311 B2 * 4/2016 Kitajima ..... H01R 13/4367
2015/0263451 A1 * 9/2015 Hashimoto ..... H01R 13/432 439/353
2015/0311628 A1 * 10/2015 Matsuura ..... H01R 13/6273 439/374

FOREIGN PATENT DOCUMENTS

JP 10064613 A * 3/1998
JP 2004-55470 2/2004
JP 2008-153066 7/2008
JP 5598849 10/2014
JP 20016-25045 2/2016

* cited by examiner

CONNECTOR

BACKGROUND

Field of the Invention

The invention relates to a connector.

Related Art

Japanese Unexamined Patent Publication No. 2004-055470 discloses a connector used in an in-vehicle LAN (Local Area Network). A wiring harness for in-vehicle LAN is configured by bundling communication wires constituting a twisted pair cable as a noise countermeasure and a power supply wire for supplying power to a device such as a car navigation system. Terminal fittings fixed to these wires are inserted into a housing from behind. Resiliently deflectable locking lances are formed in the housing and locked to terminal fittings for holding the terminal fittings in the housing in Japanese Unexamined Patent Publication No. 2016-025045.

Terminal fittings connected to two communication wires constituting a twisted pair cable are inserted individually into terminal accommodation chambers. Thus, end parts of the communication wires are untwisted to ensure an extra length at the time of individual insertion. However, a noise countermeasure function is lost in an untwisted area. As a measure against this, it is considered to configure a terminal unit by mounting the two terminal fittings connected to the two communication wires into a terminal holding member that has a halved structure and that is separate from the housing. The halved structure enables the terminal fittings to be mounted in a direction intersecting a longitudinal direction of the communication wires. Thus, the communication wires need not be untwisted and a reduction of the noise countermeasure function can be avoided.

The terminal unit can be retained by a resiliently deflectable locking lance similar to a terminal fitting connected to a power supply wire for holding the terminal unit in the housing. However, a space for deflecting the locking lance is necessary in addition to a sufficient locking area for retention by the locking lance. Thus, a connector is enlarged in a deflecting direction of the locking lance.

The invention was completed on the basis of the above situation and aims to realize miniaturization.

SUMMARY

The invention is directed to a connector with a housing and a retainer to be mounted into the housing. The retainer is displaceable between a partial locking position and a full locking position. The connector also has a terminal unit configured to be mounted into the retainer and displaced integrally with the retainer between the partial locking position and the full locking position. The connector further has a terminal holding member constituting the terminal unit and a terminal fitting fixed to a wire. The terminal fitting is mounted in the terminal holding member such that a draw-out direction of the wire from the terminal holding member is a direction intersecting a displacing direction of the retainer. A stopper is formed in the housing and faces in a direction opposite to the draw-out direction of the wire. A retaining projection is formed on the terminal holding member. The retaining projection is not locked to the stopper when the retainer is held at the partial locking position but is lockable to the stopper by displacing the retainer to the full locking position.

The terminal unit can be retained by locking the retaining projection to the stopper. Thus, a resiliently deflectable locking lance is not used for retaining the terminal unit, and miniaturization is possible.

A unit accommodating portion may be formed by the housing and the retainer to accommodate and surround the terminal unit over an entire periphery when the retainer is mounted in the housing. According to this configuration, the terminal unit can be protected from the interference of external matter.

The unit accommodating portion may include a housing-side cover formed in the housing. The housing-side cover is open in a displacing direction of the retainer from the full locking position to the partial locking position, and a retainer-side cover may be formed on the retainer to fit into the housing-side cover. The retainer-side cover may be open in a displacing direction of the retainer from the partial locking position to the full locking position. According to this configuration, material cost can be reduced as compared to the case where the housing and the retainer are formed with tubular portions to constitute the unit accommodating portion.

An insertion opening may be provided in the unit accommodating portion and enables the terminal unit to be inserted into the unit accommodating portion. According to this configuration, the terminal unit can be mounted into the retainer after the retainer is mounted into the housing. A means for holding the terminal unit mounted in the retainer can be omitted or simplified in this way. Thus, the structures of the retainer and the terminal unit can be simplified.

DETAILED DESCRIPTION

Figure 1:
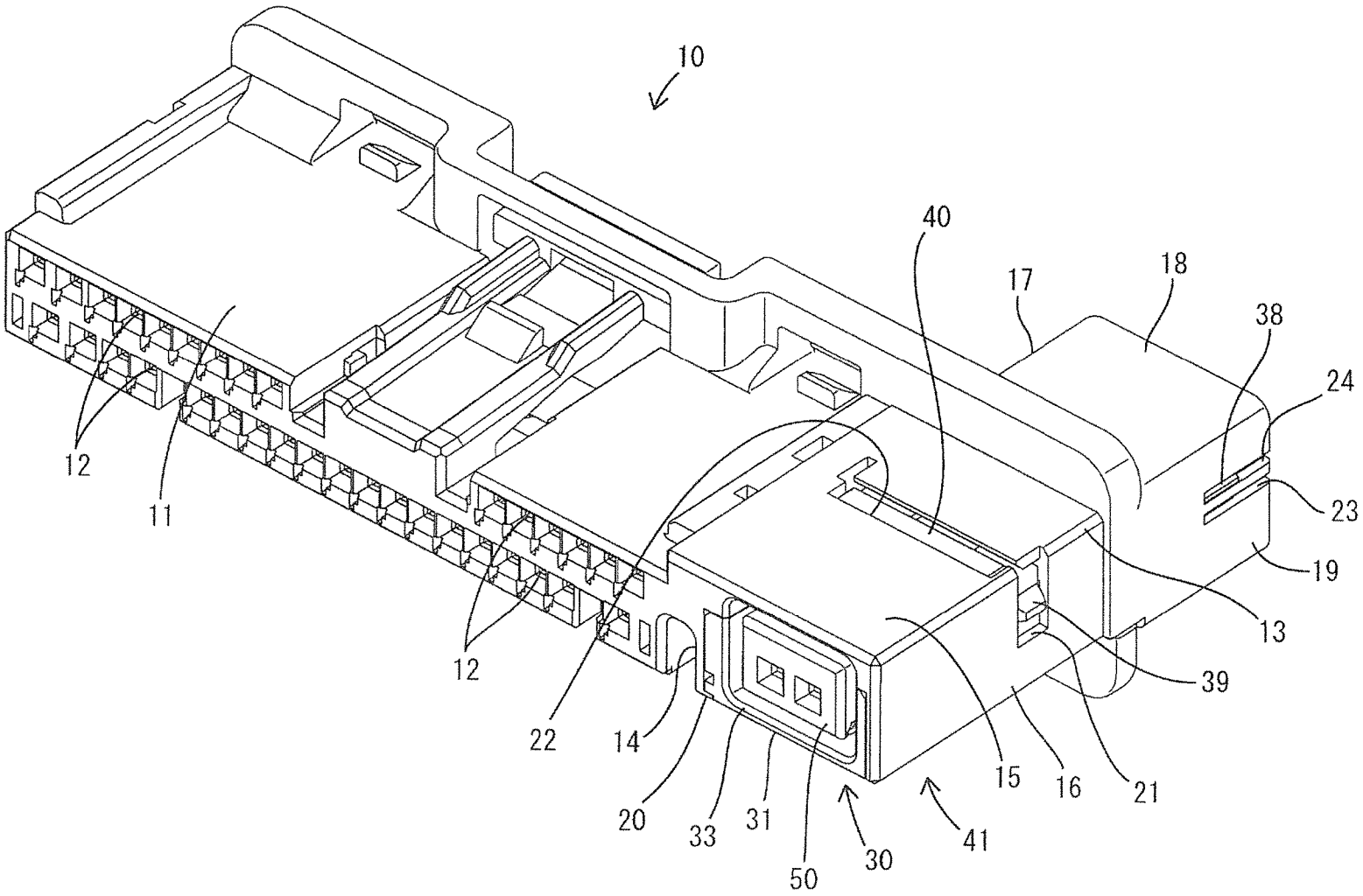
FIG. 1 is a perspective view showing a state where a retainer and a terminal unit are mounted at a full locking position in a connector of one embodiment.

One embodiment of the invention is described with reference to FIGS. 1 to 13. Note that, in the following description, a left side in FIGS. 3, 4, 6, 7, 11 and 13 is defined as a front concerning a front-rear direction. Upper and lower sides shown in FIGS. 1 to 10, 12 and 13 are defined as upper and lower sides concerning a vertical direction. Left and right sides shown in FIGS. 2, 5, 8 and 10 are defined as left and right sides concerning a lateral direction.

A connector of this embodiment includes a housing 10 made of synthetic resin, a retainer 30 made of synthetic resin and a terminal unit 50. The housing 10 has a flat shape with a lateral dimension (width) larger than a vertical dimension. A left part of the housing 10 serves as a terminal accommodating portion 11. Terminal accommodation chambers 12 are formed inside the terminal accommodating portion 11, and a female terminal (not shown) is inserted into each terminal accommodation chamber 12 from behind the housing 10. Each female terminal is connected to a wire (not shown) having no noise countermeasure taken therefor.

A housing-side cover 13 is formed in a right part of the housing 10. The housing-side cover 13 has a function of mounting the retainer 30, a function of accommodating the terminal unit 50 and a function of retaining the terminal unit 50. An internal space of the housing-side cover 13 is open downward (moving direction when the retainer 30 is displaced from a full locking position to a partial locking position) and also is open forward and rearward.

The housing-side cover 13 includes a left front wall 14 constituting the right outer side surface of the terminal accommodating portion 11, a front upper wall 15 extending horizontally rightward from the upper edge of a right end part of the terminal accommodating portion 11 and a right front wall 16 extending down from the right end edge of the front upper wall 15. The housing-side cover 13 further includes a left rear wall 17 extending rearward from the rear end edge of the left front wall 14, a rear upper wall 18 extending rearward from the rear end edge of the front upper wall 15 and a right rear wall 19 extending rearward from the rear end edge of the right front wall 16.

A supporting rib 20 extends in the front-rear direction on a lower end part of the inner side surface of the left front wall 14. Upwardly facing detachment restriction receiving portions 21 are formed at positions near the rear ends of the left front wall 14 and the right front wall 16 (detachment restriction receiving portion 21 of the left front wall 14 is not shown). The front upper wall 15 is formed with a detection opening 22 extending in the lateral direction and communicating with both left and right detachment restriction receiving portions 21. The left rear wall 17 and the right rear wall 19 are formed with partial locking holes 23 and full locking holes 24 located above the partial locking holes 23. A stopper 25 projects forward (direction opposite to a draw-out direction of wires 61 from a terminal holding member 51) on the inner surface (lower surface) of the front upper wall 15.

Figure 9:
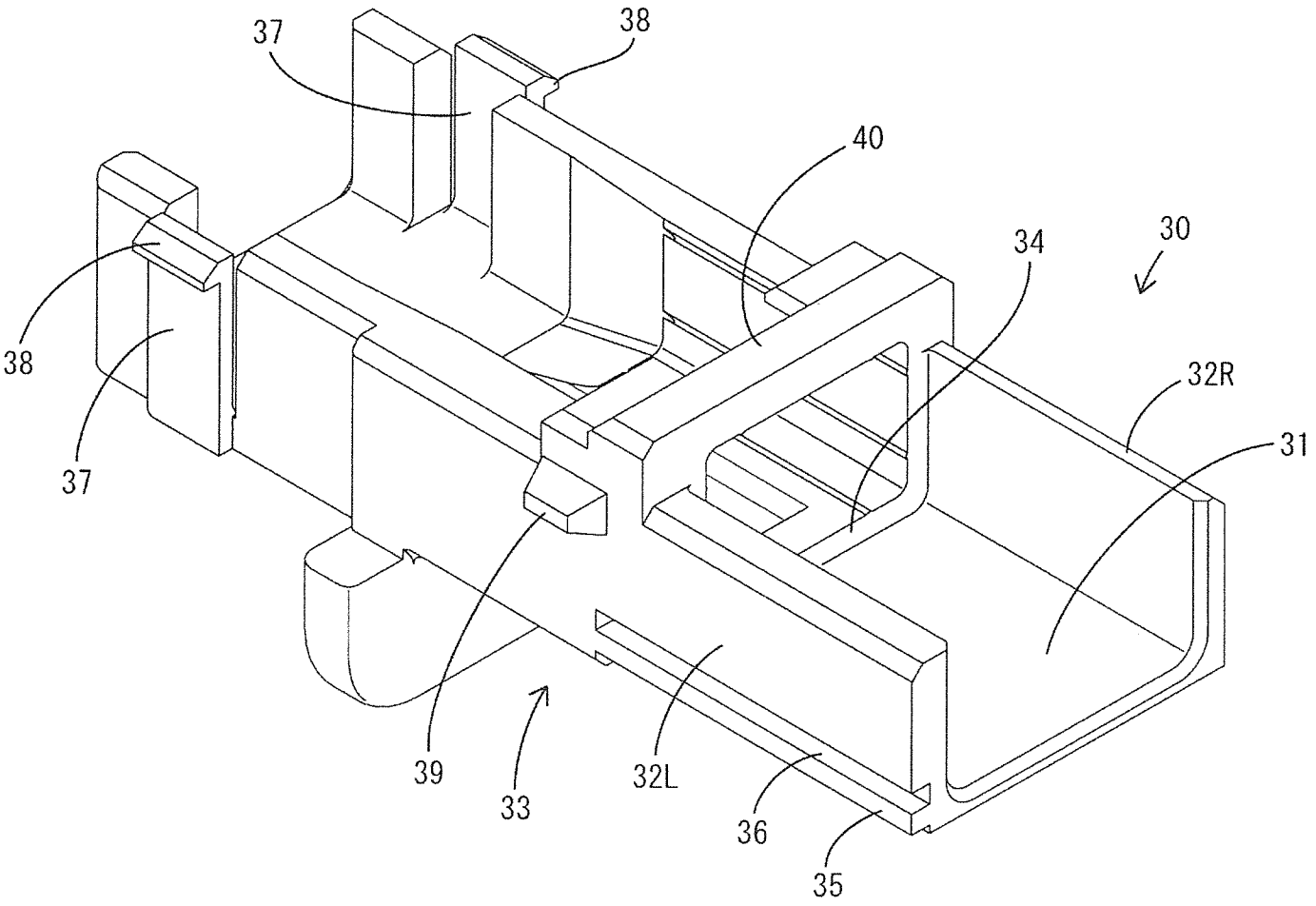
FIG. 9 is a perspective view of the retainer.
Figure 10:
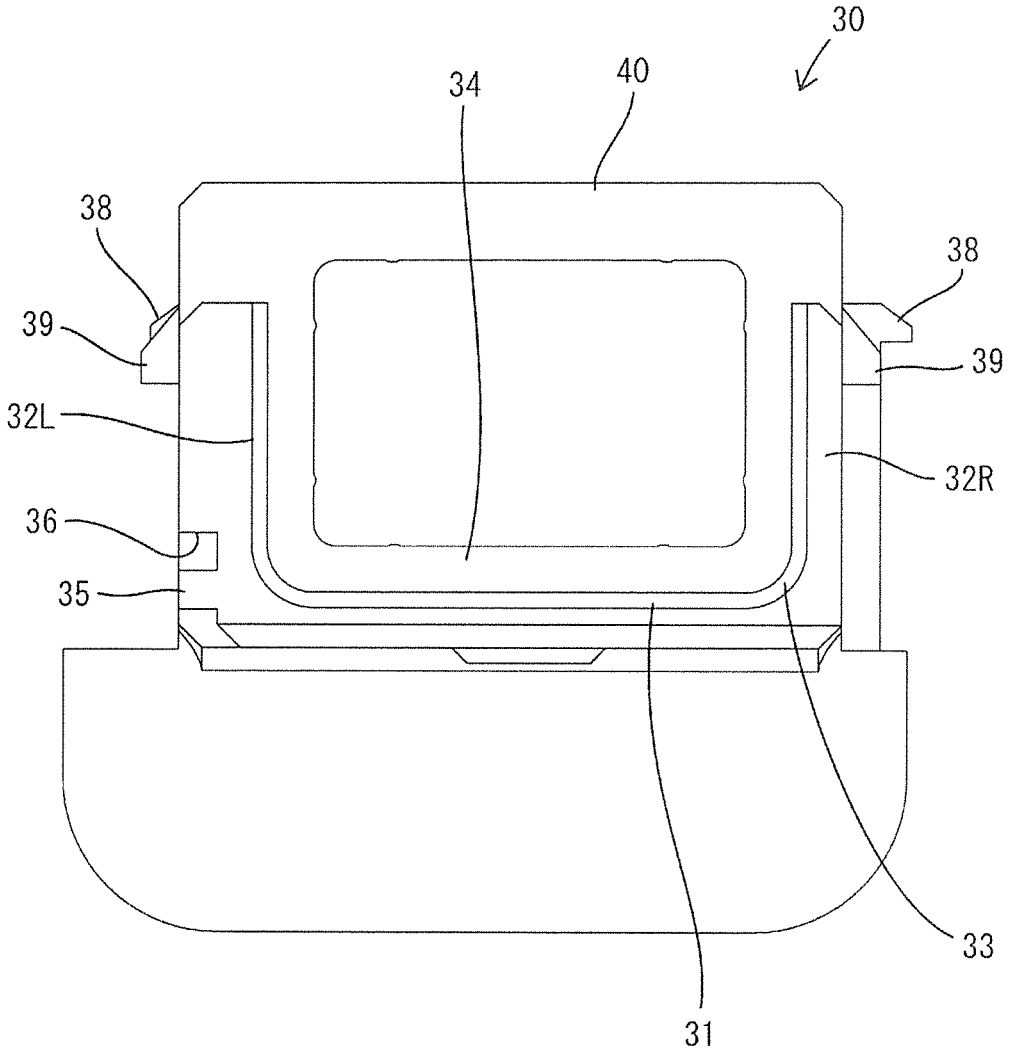
FIG. 10 is a front view of the retainer.
Figure 11:
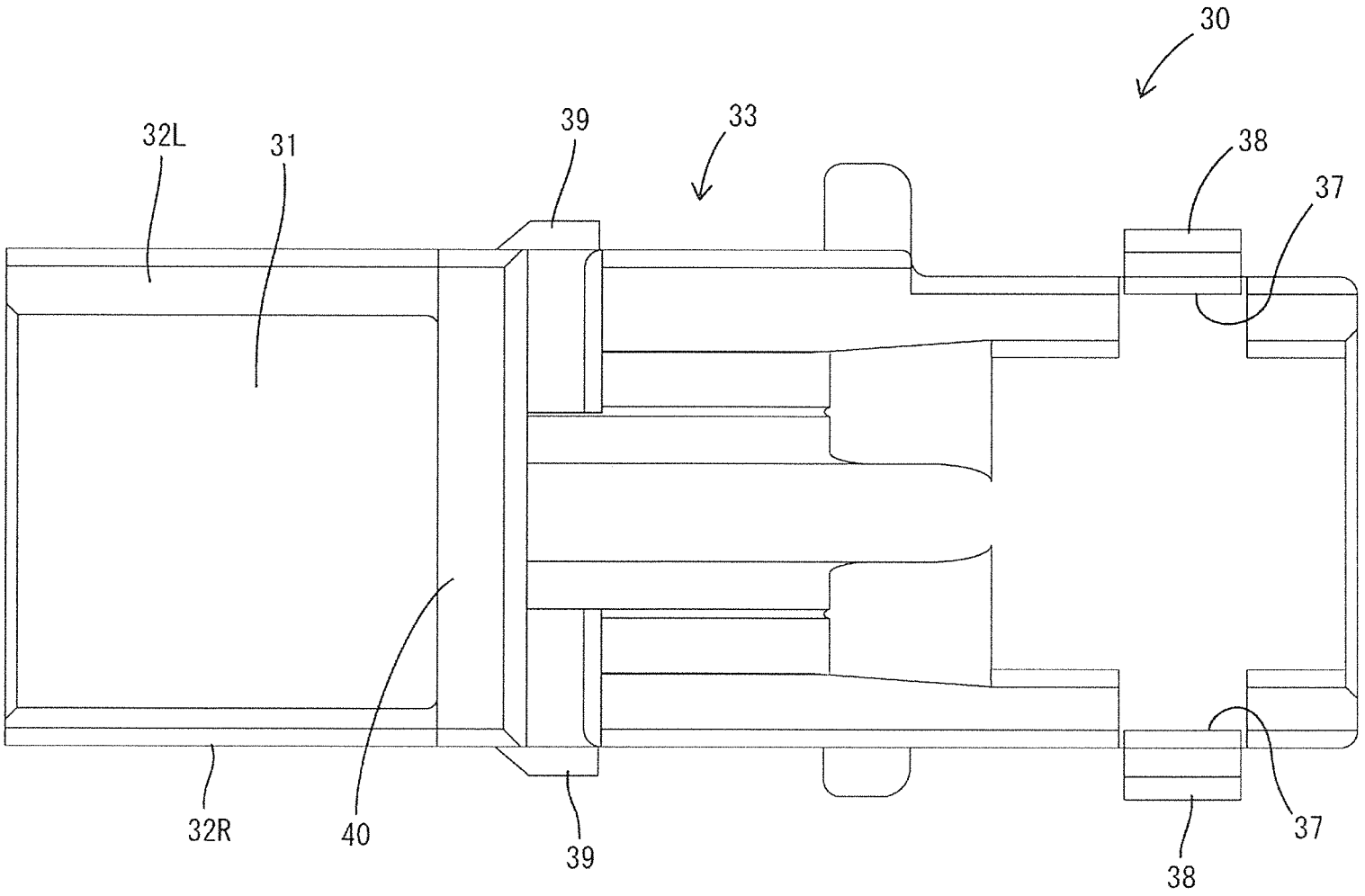
FIG. 11 is a plan view of the retainer.

As shown in FIGS. 9 to 11, the retainer 30 is a single component including a horizontal bottom wall 31, a left side wall 32L rising up from the left side of the bottom wall 31 and a right side wall 32R rising up from the right side of the bottom wall 31. The bottom wall 31, the left side wall 32L and the right side wall 32R constitute a retainer-side cover 33. An internal space of the retainer-side cover 33 accommodates the terminal unit 50, and opens up (moving direction when the retainer 30 is displaced from the partial locking position to the full locking position) contrary to the housing-side cover 13 and opens forward and rearward similar to the housing-side cover 13. A front stop 34 in the form of a projection facing rearward is formed on the upper surface of the bottom wall 31 (inside the retainer-side cover 33).

A locking rib 35 extends in the front-rear direction, and a locking groove 36 extends in the front-rear direction along an upper part of the locking rib 35 on the outer surface of a lower end part of the left side wall 32L. Resilient arms 37 are respectively formed on rear end parts of the left and right side walls 32L, 32R. The resilient arms 37 are cantilevered up from the lower ends thereof and are resiliently displaceable in the lateral direction Locking projections 38 are formed on upper end parts of the outer side surfaces of the resilient arms 37.

Detachment restricting portions 39 in the form of projections are formed on upper end parts of the outer side surfaces of the left and right side walls 32L, 32R. The detachment restricting portions 39 are disposed substantially at center positions of the left and right side walls 32L, 32R in the front-rear direction. The upper end edges of the left and right side walls 32L, 32R are coupled by a beam 40 extending in the lateral direction. The beam 40 and the detachment restricting portions 39 are disposed at the same position in the front-rear direction.

The retainer 30 is fit into the housing-side cover 13 from below the housing 10 and can be mounted selectively at the partial locking position and the full locking position with respect to the housing 10. In a fitting state, the retainer-side cover 33 is accommodated inside the housing-side cover 13, the left side wall 32L overlaps with the inner surfaces of the left front wall 14 and the left rear wall 17, and the right side wall 32R overlaps with the inner surfaces of the right front wall 16 and the right rear wall 19. The bottom wall 31 closes the lower surface of the internal space of the housing-side cover 13. A unit accommodating portion 41 in the form of a rectangular tube with open front and rear surfaces is constituted by the housing-side cover 13 and the retainer-side cover 33. A rear end opening of the unit accommodating portion 41 serves as an insertion opening 42 through which the terminal unit 50 is accommodated into the unit accommodating portion 41.

Figure 5:
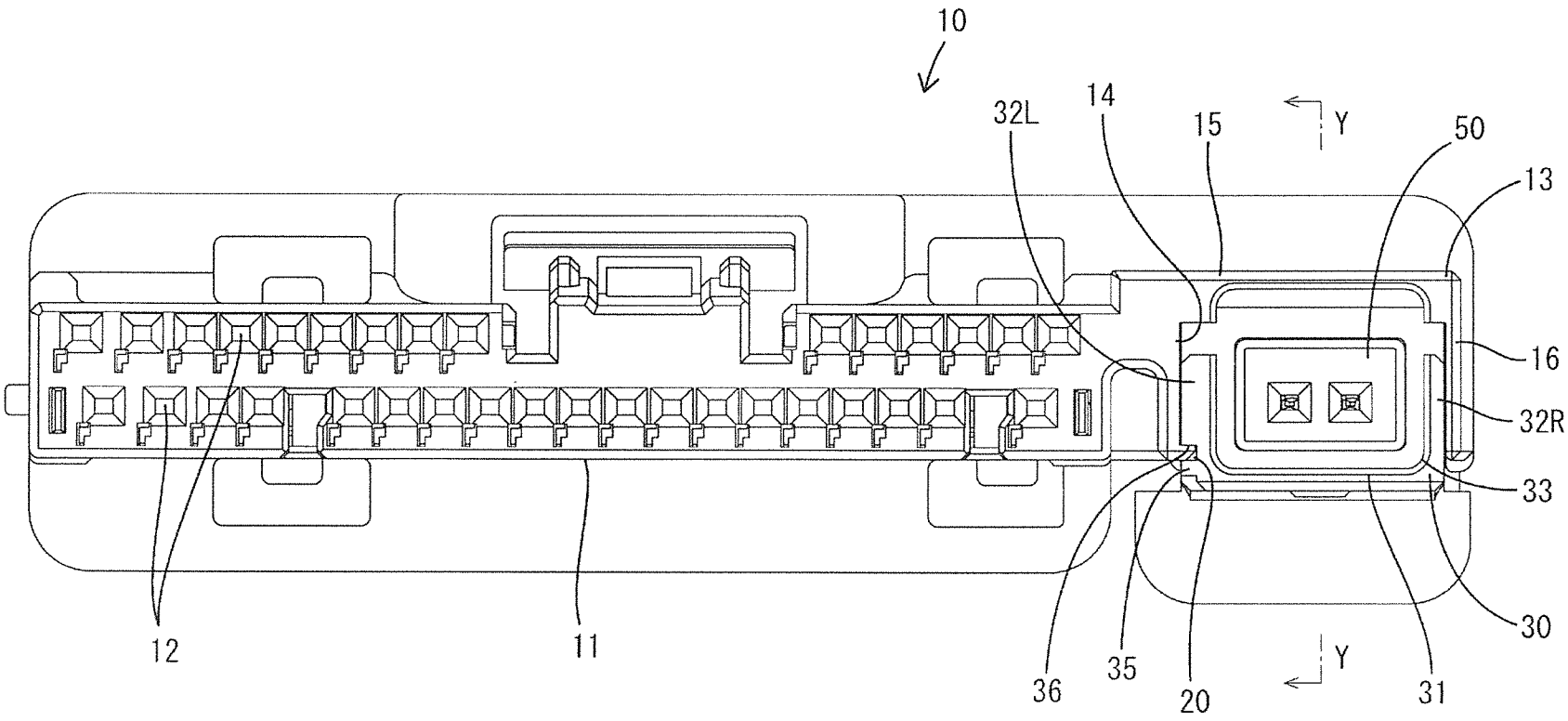
FIG. 5 is a front view showing a state where the retainer and the terminal unit are mounted at a partial locking position.
Figure 6:
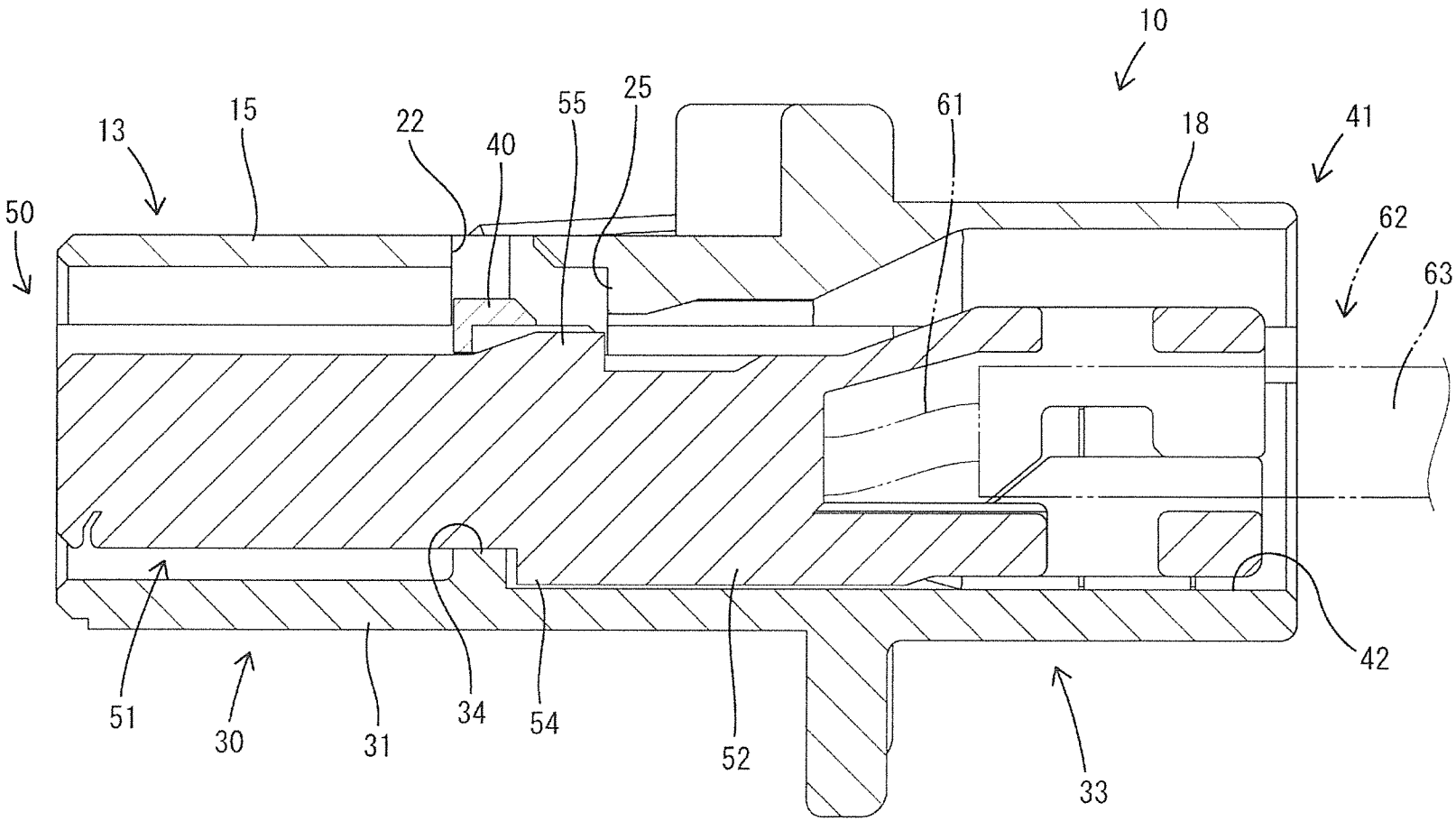
FIG. 6 is a section along Y-Y of FIG. 5.
Figure 7:
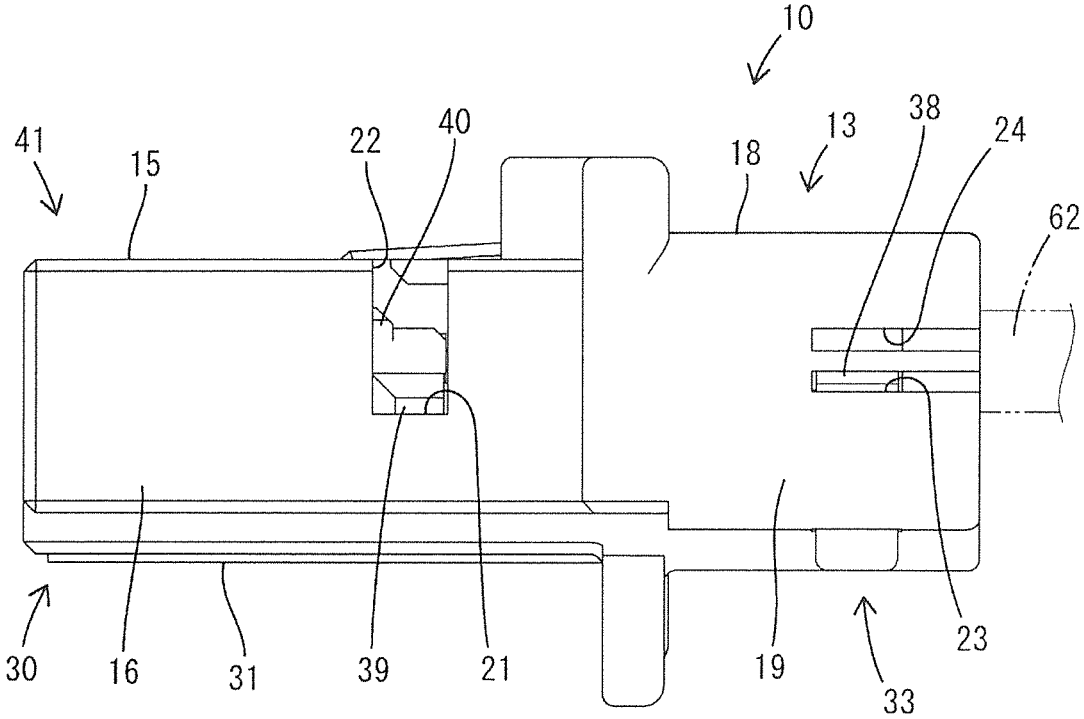
FIG. 7 is a side view showing the state where the retainer and the terminal unit are mounted at the partial locking position.
Figure 8:
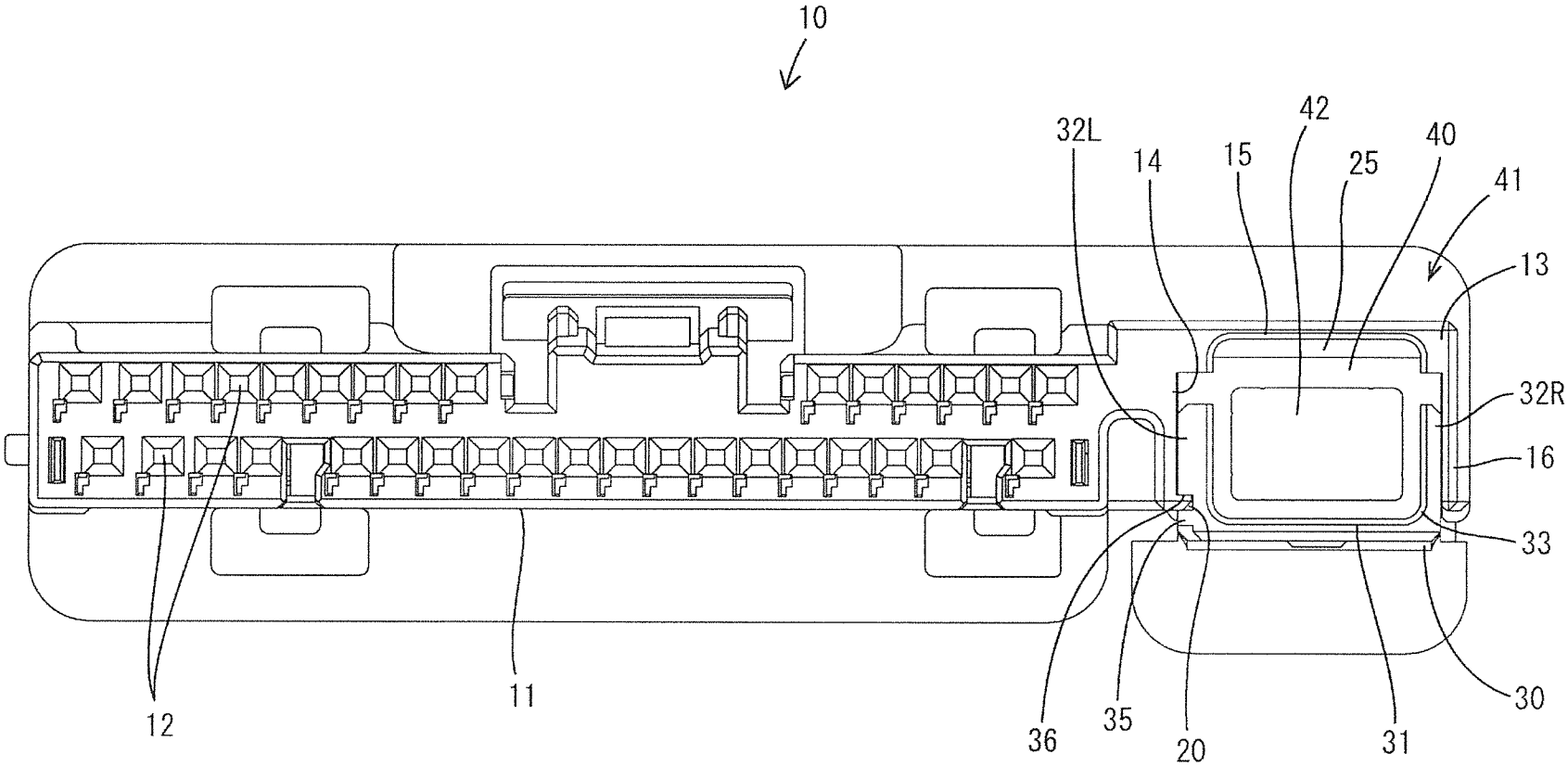
FIG. 8 is a front view showing a state where the retainer is mounted at the partial locking position of a housing.

The locking groove 36 is fit to the supporting rib 20, as shown in FIGS. 5 and 8, and the locking projection 38 is locked to the partial locking hole 23, as shown in FIG. 7. Thus, the retainer 30 is held at the partial locking position. At this time, the detachment restricting portions 39 are locked to the detachment restriction receiving portions 21 so that downward detachment of the retainer 30 from the housing 10 is restricted and relative displacements of the retainer 30 in the front-rear direction with respect to the housing 10 are restricted.

Figure 2:
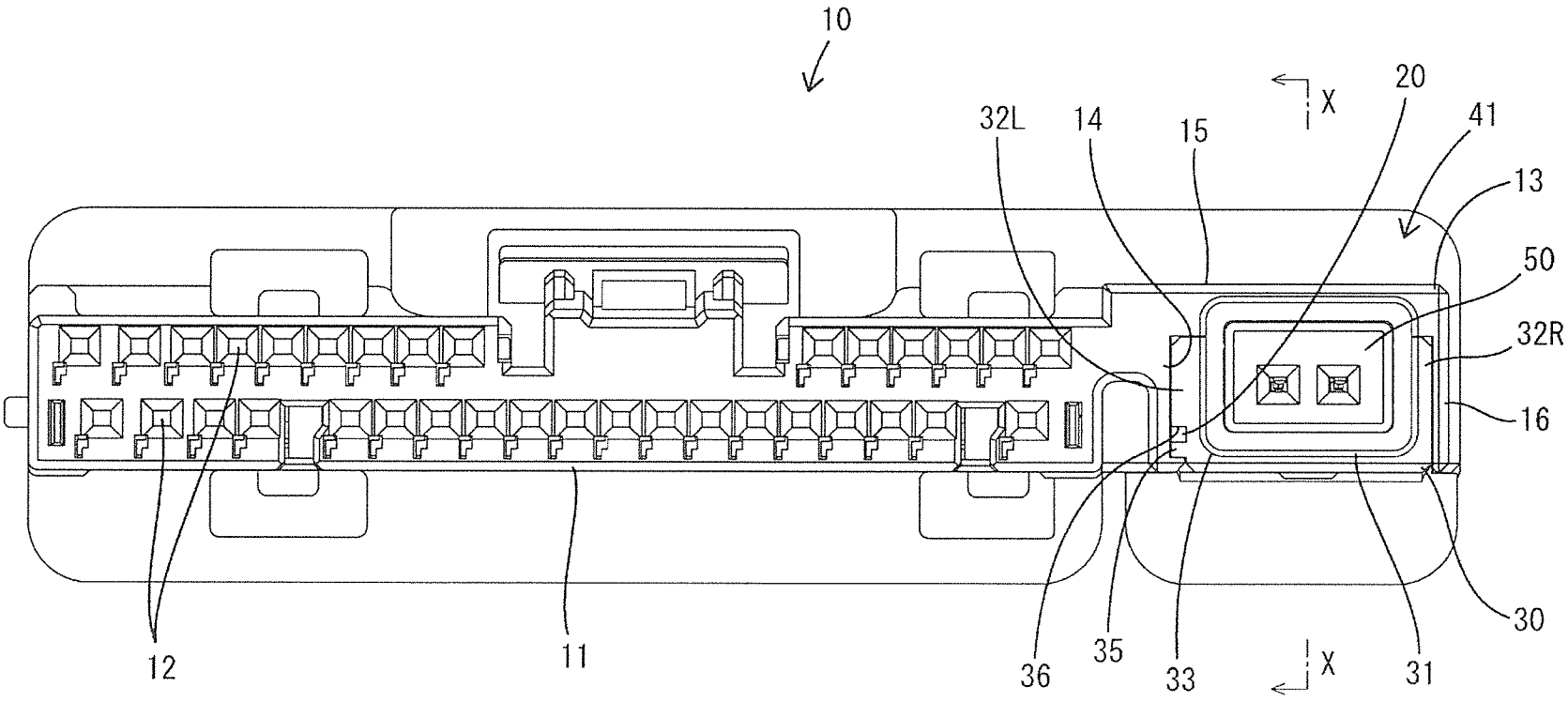
FIG. 2 is a front view showing the state where the retainer and the terminal unit are mounted at the full locking position.
Figure 3:
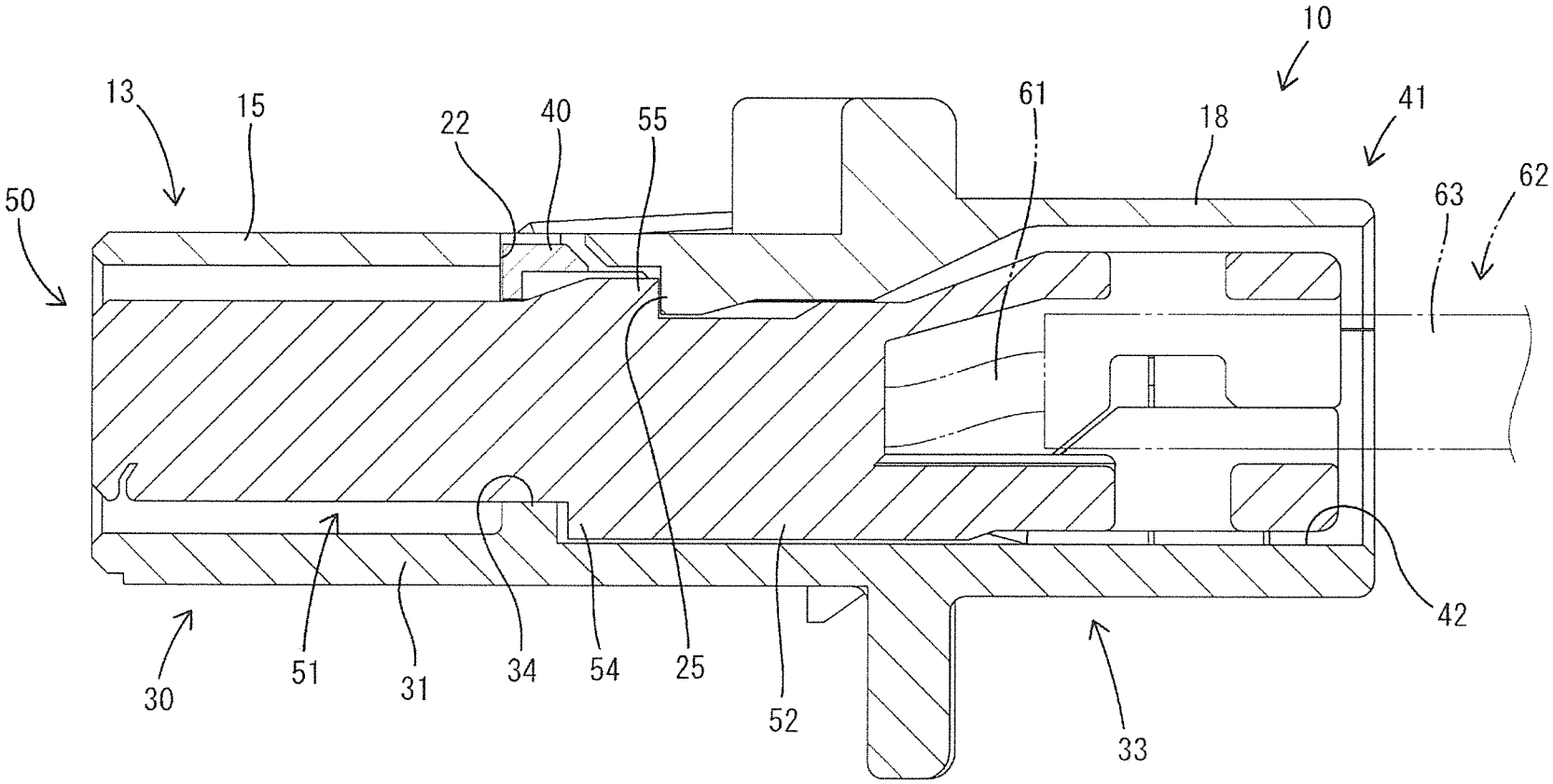
FIG. 3 is a section along X-X of FIG. 2.
Figure 4:
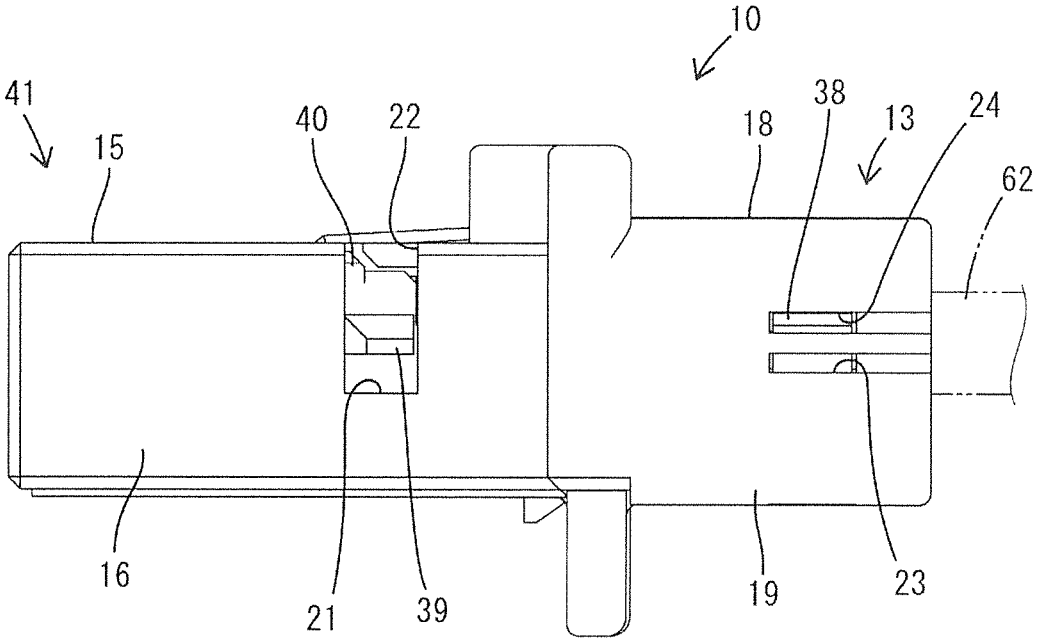
FIG. 4 is a side view showing the state where the retainer and the terminal unit are mounted at the full locking position.

Further, the locking rib 35 is placed on the upper surface of the supporting rib 20, as shown in FIG. 2, and the locking projection 38 is locked to the full locking hole 24, as shown in FIGS. 1 and 2 to hold the retainer 30 at the full locking position. The full locking position is a position above the partial locking position. Thus, when the retainer 30 is at the partial locking position, the beam 40 is located below the detection opening 22. However, when the retainer 30 moves up to the full locking position, the beam 40 enters the detection opening 22 and the presence of the beam portion 40 easily can be confirmed visually from the outside of the housing 10.

Figure 12:
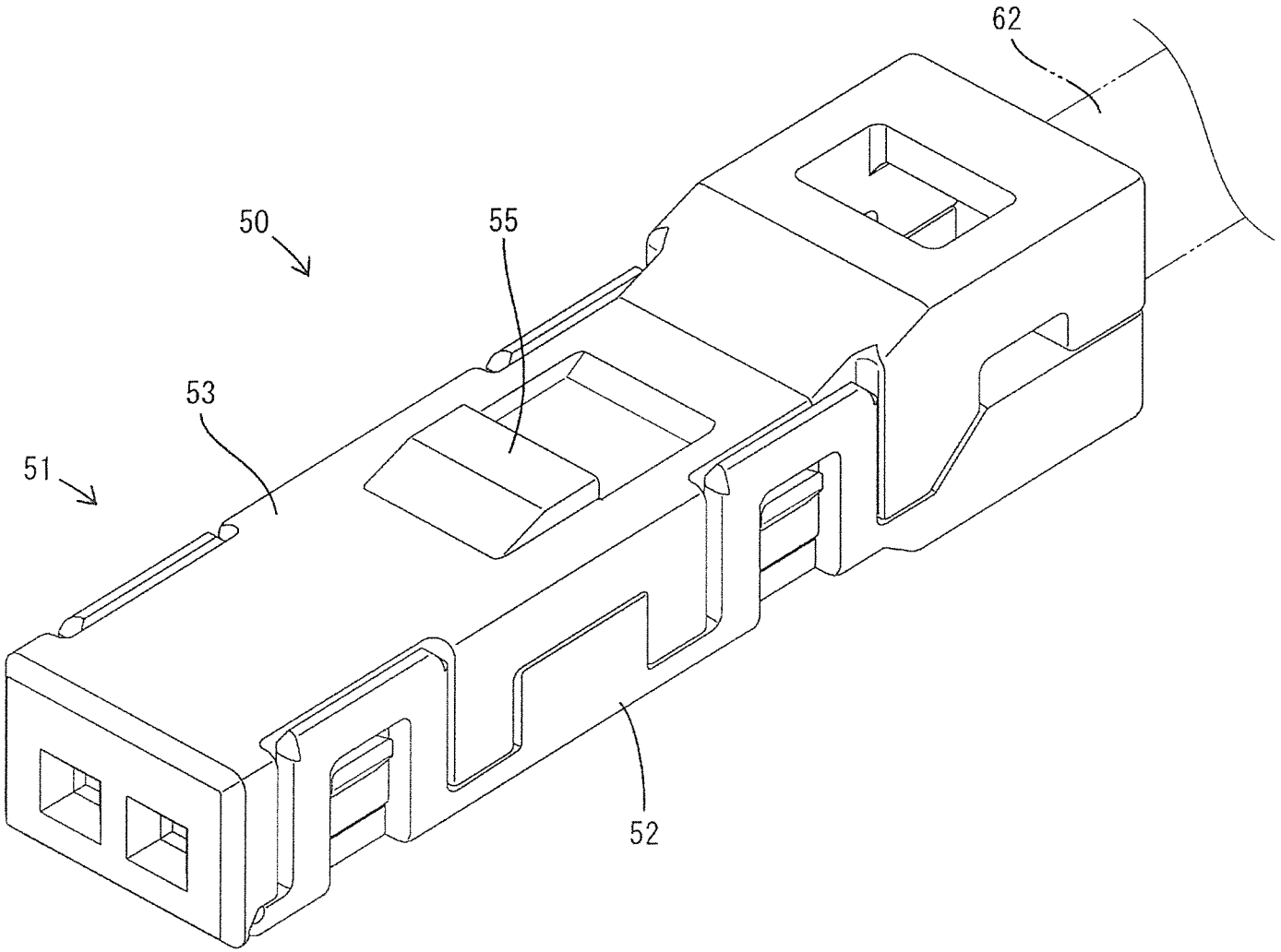
FIG. 12 is a perspective view of the terminal unit.
Figure 13:
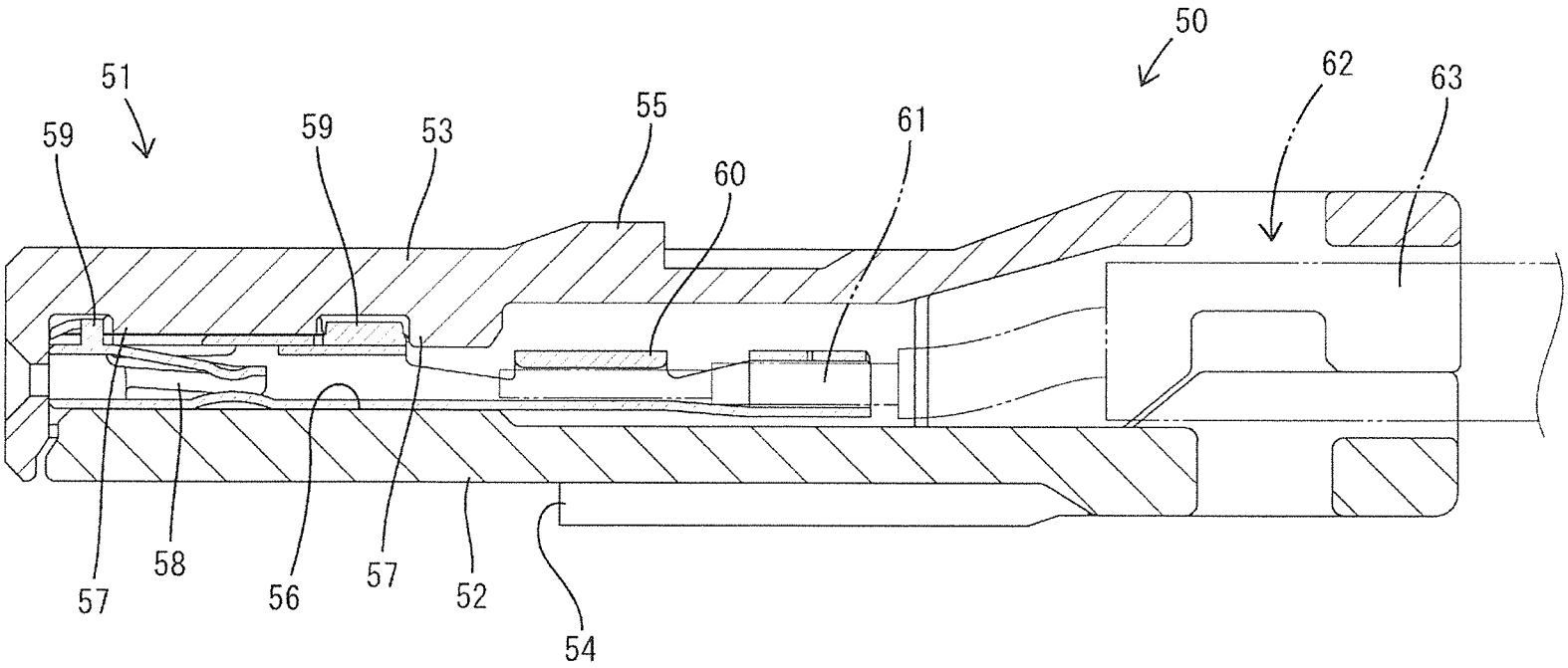
FIG. 13 is a side view in section of the terminal unit.

The terminal unit 50 includes the terminal holding member 51 made of synthetic resin and two terminal fittings 58. The terminal unit 50 is connected to a front end part of a twisted pair cable 62. As shown in FIGS. 12 and 13, the terminal unit 50 is long and narrow in the front-rear direction and is inserted into the unit accommodating portion 41 from behind the housing 10.

The terminal holding member 51 is configured by vertically uniting and assembling a lower case 52 and an upper case 53. A forwardly facing butting portion 54 is formed on the lower surface (outer surface) of the lower case 52. A rearward facing retaining projection 55 is formed on the upper surface (outer surface) of the upper case 53. Left and right terminal accommodation spaces 56 are formed inside the terminal holding member 51, and front and rear terminal retaining portions 57 are formed on the upper surface of each terminal accommodation space 56.

The terminal fittings 58 are accommodated in the terminal accommodation spaces 56 when the lower case 52 and the upper case 53 are united. Front and rear detachment restricting projections 59 of the terminal fitting 58 are locked by the terminal retaining portions 57, thereby restricting rearward detachment of the terminal fitting 58 from the terminal holding member 51.

Front end parts of the wires 61 are connected individually to crimping portions 60 on rear end parts of the respective terminal fittings 58. These wires 61 are used as communication wires (signal wires) and constitute the twisted pair cable 62 having a noise reduction function by being spirally twisted. In an area of the twisted pair cable 62 excluding a front end part, the two wires 61 are surrounded collectively by a sheath 63. A front end part of the sheath 63 also is accommodated in rear end parts of the terminal accommodation spaces 56. Thus, the wires 61 (twisted pair cable 62) are drawn out rearward from the terminal holding member 51.

A mounting direction of the terminal fittings 58 into the terminal holding member 51 (i.e. a uniting direction of the lower case 52 and the upper case 53) intersects the draw-out direction of the wires 61 from the terminal holding member 51 (longitudinal direction of the twisted pair cable 62). Thus, the wires 61 need to be exposed only by a length necessary to crimp the crimping portions 60 of the terminal fittings 58 and the wires 61 by a crimping machine (applicator) by removing the sheath 63 in the front end part of the twisted pair cable 62.

The connector is assembled in the following procedure. First, the retainer 30 is mounted at the partial locking position of the housing 10. In this way, the unit accommodating portion 41 having the rear end open as the insertion opening 42 is formed in a right end part of the housing 10. Subsequently, the terminal unit 50 is inserted into the unit accommodating portion 41 from behind the housing 10. When the terminal unit 50 reaches a proper insertion position, the butting portion 54 of the terminal unit 50 butts against the front stop 34 of the retainer 30, thereby restricting any further insertion of the terminal unit 50. In this state, the retaining projection 55 is disposed at a position slightly below the stopper 25 and slightly in front of the stopper 25.

If the lower surface (outer surface) of the bottom wall 31 is pushed up from this state, the retainer 30 moves from the partial locking position to the full locking position and the terminal unit 50 also moves from the partial locking position to the full locking position integrally with the retainer 30. According to this movement, the retaining projection 55 is displaced to the same height as the stopper 25 and the rear surface of the retaining projection 55 comes close to the front surface of the stopper 25 to face and be lockable to the stopper 25 in the front-rear direction. Even if a rearward pulling force acts on the terminal unit 50 in this state, the retaining projection 55 is locked to the stopper 25. Therefore, the terminal unit 50 is not displaced rearward with respect to the retainer 30 and the housing 10.

If the terminal unit 50 is deviated rearward from a proper position when the retainer 30 is moved from the partial locking position to the full locking position, the retaining projection 55 comes into contact with the stopper 25 from below. As a result, the retainer 30 cannot be moved to the full locking position. Thus, the terminal unit 50 is not mounted at an improper position (position where the terminal fittings 58 are deviated rearward from proper positions) with respect to the housing 10. Further, whether or not the retainer 30 has moved to the full locking position can be confirmed by seeing whether or not the beam 40 of the retainer 30 has entered the detection opening 22. In detaching the terminal unit 50 from the housing 10, the terminal unit 50 may be pulled out rearward from the housing 10 after the retainer 30 and the terminal unit 50 are moved from the full locking position to the partial locking position.

As described above, the connector of this embodiment includes the housing 10, the retainer 30 mounted in the housing 10 and the terminal unit 50 mounted in the retainer 30. The retainer 30 is displaceable between the partial locking position and the full locking position, and the terminal unit 50 is configured to be displaced between the partial locking position and the full locking position integrally with the retainer 30. The terminal holding member 51 and the terminal fittings 58 constitute the terminal unit 50. The terminal fittings 58 are fixed to front end parts of the wires 61 and mounted in the terminal holding member 51 so that the draw-out direction (rearward direction) of the wires 61 from the terminal holding member 51 is a direction intersecting a displacing direction (vertical direction) of the retainer 30.

The housing 10 is formed with the stopper 25 facing in the forward direction opposite to the draw-out direction of the wires 61. The terminal holding member 51 is formed with a retaining projection 55 that is not locked to the stopper 25 when the retainer 30 is held at the partial locking position and can be locked to the stopper 25 by displacing of the retainer 30 to the full locking position. According to this configuration, if the wires 61 are pulled, the retaining projection 55 butts against the stopper 25 to hold the terminal unit 50 in the housing 10. Since a resiliently deflectable locking lance is not used for retaining the terminal unit 50, the miniaturization (height reduction) of the connector can be realized. Further, since the retaining projection 55 and the stopper 25 can be transitioned from a non-locking state to a locking state without being resiliently deflected, the reliability of a retaining function is excellent.

Further, with the retainer 30 mounted in the housing 10, the unit accommodating portion 41 is formed by the housing and the retainer 30 regardless of whether the retainer 30 is at the partial locking position or at the full locking position. The unit accommodating portion 41 accommodates and surrounds the terminal unit 50 over the entire periphery. Accordingly, the terminal unit 50 is protected from the interference of external matter.

Further, the housing 10 is formed with the housing-side cover 13 open in a displacing direction (downward direction) of the retainer 30 from the full locking position to the partial locking position, and the retainer 30 is formed with the retainer-side cover 33 fittable into the housing-side cover 13. The retainer-side cover 33 is open in a displacing direction of the retainer 30 from the partial locking position to the full locking position (i.e. a direction opposite to the direction in which the housing-side cover 13 is open). According to this configuration, material cost can be reduced as compared to the case where the housing 10 and the retainer 30 are formed with tubular portions to constitute the unit accommodating portion 41.

Further, the unit accommodating portion 41 is formed with the insertion opening 42 for enabling the insertion of the terminal unit 50 into the unit accommodating portion 41. Thus, the terminal unit 50 is mounted into the retainer 30 after the retainer 30 is mounted into the housing 10. Since a means for holding the terminal unit 50 mounted in the retainer 30 can be omitted or simplified in this way, the structures of the retainer 30 and the terminal unit 50 can be simplified.

The invention is not limited to the above described and illustrated embodiment. For example, the following embodiments also are included in the scope of the invention.

Although the terminal unit is accommodated into the unit accommodating portion to be surrounded over the entire periphery with the terminal unit mounted in the retainer in the above embodiment, a part of the terminal unit in a circumferential direction may be exposed to outside with the terminal unit mounted in the retainer.

Although both the housing-side cover and the retainer-side cover constituting the unit accommodating portion 41 are partially open in the circumferential direction in the above embodiment, one or both of the housing-side cover and the retainer-side cover may be tubular.

Although the terminal unit is mounted into the retainer after the retainer is mounted into the housing in the above embodiment, the terminal unit may be mounted into the retainer before the retainer is mounted into the housing.

LIST OF REFERENCE SIGNS

10 . . . housing
13 . . . housing-side cover
25 . . . stopper
30 . . . retainer
33 . . . retainer-side cover
41 . . . unit accommodating portion
42 . . . insertion opening
50 . . . terminal unit
51 . . . terminal holding member
54 . . . butting portion
58 . . . terminal fitting
61 . . . wire

The invention claimed is:

1. A connector, comprising:

a housing having opposite front and rear end spaced apart along a rear-front direction;

a retainer to be mounted into the housing in a transverse direction that is transverse to the rear-front direction, the retainer being displaceable in the transverse direction between a partial locking position and a full locking position;

a terminal unit mounted in the retainer along the rear-front direction and configured to be displaced in the transverse direction between the partial locking position and the full locking position integrally with the retainer, the terminal unit including a terminal holding member made of synthetic resin and a terminal fitting fixed to a wire, the terminal fitting being mounted in the terminal holding member such that a draw-out direction of the wire from the terminal holding member is a direction intersecting the transverse direction of displacement of the retainer;

a stopper formed in the housing, the stopper facing in a direction opposite to the draw-out direction of the wire; and a retaining projection formed on the terminal holding member, the retaining projection being not locked to the stopper with the retainer held at the partial locking position and being lockable to the stopper by a displacement of the retainer to the full locking position.

2. The connector of claim 1, wherein the housing and the retainer that is mounted in the housing form a unit accommodating portion that accommodates and surrounds the terminal unit over an entire periphery.

3. The connector of claim 2, wherein the unit accommodating portion includes:

a housing-side cover formed in the housing, the housing-side cover being open in a displacing direction of the retainer from the full locking position to the partial locking position; and a retainer-side cover formed on the retainer and being fittable into the housing-side cover, the retainer-side cover being open in a displacing direction of the retainer from the partial locking position to the full locking position.

4. The connector of claim 3, comprising an insertion opening provided in the unit accommodating portion, the insertion opening enabling the terminal unit to be inserted into the unit accommodating portion.

5. A connector, comprising:

a housing;

a retainer mounted into the housing to form a unit accommodating portion, the retainer being displaceable between a partial locking position and a full locking position with respect to the housing, an insertion opening provided in the unit accommodating portion;

a terminal unit mounted through the insertion opening and into the unit accommodating portion so that the unit accommodating portion that accommodates and surrounds the terminal unit over an entire periphery, the terminal unit being configured to be displaced between the partial locking position and the full locking position integrally with the retainer, the terminal unit including a terminal holding member and a terminal fitting fixed to a wire, the terminal fitting being mounted in the terminal holding member such that a draw-out direction of the wire from the terminal holding member is a direction intersecting a displacing direction of the retainer;

a stopper formed in the housing, the stopper facing in a direction opposite to the draw-out direction of the wire; and a retaining projection formed on the terminal holding member, the retaining projection being not locked to the stopper with the retainer held at the partial locking position and being lockable to the stopper by a displacement of the retainer to the full locking position.

6. A connector, comprising:

a housing;

a retainer mounted into the housing to form a unit accommodating portion, the retainer being displaceable between a partial locking position and a full locking position with respect to the housing, the unit accommodating portion includes:

a housing-side cover formed in the housing, the housing-side cover being open in a displacing direction of the retainer from the full locking position to the partial locking position; and a retainer-side cover formed on the retainer and being fittable into the housing-side cover, the retainer-side cover being open in a displacing direction of the retainer from the partial locking position to the full locking position;

a terminal unit mounted in the retainer so that the unit accommodating portion accommodates and surrounds the terminal unit over an entire periphery and the terminal unit being configured to be displaced between the partial locking position and the full locking position integrally with the retainer, the terminal unit including a terminal holding member and a terminal fitting fixed to a wire, the terminal fitting being mounted in the terminal holding member such that a draw-out direction of the wire from the terminal holding member is a direction intersecting a displacing direction of the retainer;

a stopper formed in the housing, the stopper facing in a direction opposite to the draw-out direction of the wire; and a retaining projection formed on the terminal holding member, the retaining projection being not locked to the stopper with the retainer held at the partial locking position and being lockable to the stopper by a displacement of the retainer to the full locking position.

7. The connector of claim 6, comprising an insertion opening provided in the unit accommodating portion, the insertion opening enabling the terminal unit to be inserted into the unit accommodating portion.

* * * * *